United States Patent [19]

Etesam

[11] Patent Number: 4,785,485

[45] Date of Patent: Nov. 22, 1988

[54] THREE PANEL BATH ENCLOSURE

[75] Inventor: Mehran Etesam, North Miami, Fla.

[73] Assignee: Keller Industries, Miami, Fla.

[21] Appl. No.: 5,409

[22] Filed: Jan. 20, 1987

[51] Int. Cl.[4] ..... A47K 3/08; A47K 3/14; A47K 3/22

[52] U.S. Cl. ..... 4/557; 4/558; 4/607; 4/608; 4/610; 49/404; 49/409; 49/410

[58] Field of Search ..... 4/557, 558, 607, 608; 49/425, 410, 409, 404, 411, 407

[56] References Cited

U.S. PATENT DOCUMENTS

| | | | |
|---|---|---|---|
| 499,222 | 6/1893 | Gardner | 49/410 X |
| 2,374,490 | 4/1945 | Lehman | 4/557 |
| 2,977,645 | 4/1961 | Tysdal | 49/410 |
| 3,100,916 | 8/1963 | McKinney | 49/410 X |
| 3,783,456 | 1/1974 | Doan | 4/557 |
| 3,805,450 | 4/1974 | Forcina | 49/409 X |
| 3,896,508 | 7/1975 | Doan | 4/557 |
| 4,014,070 | 3/1977 | Rifkin | 49/410 X |
| 4,090,265 | 5/1978 | Baus | 4/607 |
| 4,176,496 | 12/1979 | Rock et al. | 49/410 |
| 4,228,560 | 10/1980 | Baus | 4/607 X |
| 4,258,443 | 3/1981 | Baus | 4/557 |
| 4,458,449 | 7/1984 | Breuer | 49/411 |
| 4,606,081 | 8/1986 | Baus | 4/557 |
| 4,661,436 | 9/1986 | Williams | 4/557 X |

FOREIGN PATENT DOCUMENTS

| | | | |
|---|---|---|---|
| 2845876 | 4/1980 | Fed. Rep. of Germany | 4/607 |

*Primary Examiner*—Henry K. Artis

*Attorney, Agent, or Firm*—Steele, Gould & Fried

[57] ABSTRACT

A sliding panel closure having three panels suspended from a header with three parallel tracks, has a sill disposed under the header with a sill channel opening downwardly and inwardly toward a bath enclosure or the like. A first of the door panels has a lower edge straddling the sill channel. The second and third of the panels have lower edges provided with guide means including outriggers slidable in the sill channel. A C-shaped guide positions the second panel relative to the sill, the outrigger being one of the legs of the C-shape. A E-shaped guide positions the second and third panels relative to one another and relative to the sill channel. The panels preferably have means along their vertical edges that allow the panels to lap but prevent adjacent panels from passing completely by one another.

14 Claims, 3 Drawing Sheets

THREE PANEL BATH ENCLOSURE

Background of the Invention

1. Field of the Invention

This invention relates to the field of sliding doors, and in particular to a multi panel bath enclosure in which the lower edges of panels slidable on a header track are guided relative to one another and relative to a sill.

2. Prior Art

Sliding panel closures such as those used for bath enclosures are known, with some variety. Upper and lower elongated track-defining members are usually disposed in the sliding direction, defining sides of the opening. Typically, an upper track or "header" has spaced parallel channels for receiving rollers mounted at the top edges of two or more door panels slidable in the opening such that the panels hang from the tracks. The bottom edges of the panels could hang free but are usually also guided such that the panels cannot swing laterally. The bottom edges can be confined between flanges, for example on a sill piece, such that the panels cannot be swung or canted and therefore put in danger of derailing from the header track.

The flanges confining the bottom edges, for example on a sill piece guiding the lower edges, must define some sort of abutment extending into the closure area, as a means to block transverse movements of the lower edge of the door panels. In one form of known slidable panel closure, a sill piece with three standing flanges defining two spaced tracks for the lower edges of two door panels keep the panels in alignment against transverse movement. This relatively-simple arrangement has one drawback in that the panels can be canted (i.e., tilted in their sliding direction) and therefore easily derailed from the header tracks. Furthermore, the use of such upward facing channels in a bath enclosure requires some form of drain structure and inherently causes a buildup of hair and dirt in the channels. These units require frequent cleaning, and the cleaning of draining channels can be tedious. The channels must be provided with drains leading into the bath enclosure, to drain away the water that runs down the panels into the sill tracks. U.S. Pat. No. 3,805,450—Forcina discloses a two panel arrangement characterized by sill tracks, in which the sill piece has narrow individual depressions for extensions of the lower edges of the panels.

To avoid a buildup of dirt and hair in the sill piece and to facilitate cleaning, it is helpful to provide as uncomplicated a sill surface as possible, avoiding anything approaching a receptacle for dirt, hair and/or water. The prior art has accordingly attempted to guide the lower edges of multiplanel closures with various sills and the like. In U.S. Pat. No. 4,014,070—Rifkin, door panels are carried on a single standing flange extending perpendicularly upwardly from the sill piece. The edges of the door panels are provided with guide members having a means extending over the standing sill flange. This arrangement is relatively uncomplicated, but requires a dangerously-sharp sill piece (i.e., the standing flange of the sill piece). Such an arrangement is also not readily extendable to an embodiment for three or more lapping panels, which would require a rather complex set of overlapping and underlapping guide pieces.

In multi-panel bath enclosures, various means have been attempted to avoid complicated dirt-catching sill pieces. In U.S. Pat. No. 3,896,508 —Doan, the door panels are mounted off center from their tracks and tend to remain aligned at their lower edges due to gravity urging the panels against a step in the sill. This arrangement benefits from a very-simple sill piece that cannot accumulate dirt. However, the arrangement can be expected to provide substantial additional friction and wear on the door panels.

U.S. Pat. Nos. 4,090,265 and 4,606,081, both the Baus, employ magnetic attraction to keep the lower panel edges in place. The attraction may be directed horizontally or vertically in the various embodiments. Horizontal attraction can be expected to increase friction as in Doan, and vertical attraction will be relatively insecure in that the user can easily push the door edge out of alignment against the force of magnetic attraction. Therefore, although these magnetic-attraction guides are characterized by a relatively smooth upward contour on the sill, that will not accumulate dirt (especially in the vertical-attraction embodiment), they have certain drawbacks.

In closures unrelated to bath enclosures, there are a number of known apparatus for aligning the lower edges of doors. Frequently, a standing sill flange is unacceptable due to the danger of tripping a person walking through the opening. Therefore, interengaging guide pieces have been used, for example as shown in U.S. Pat. No. 3,100,916—McKinney (FIGS. 3 and 5). U.S. Pat. No. 2,977,645—Tysdal discloses a cell door engaging a sill-like flange directed downwardly at the lower edge of the closure, for added security against lifting the closure panel out of its header track.

Multi-panel enclosures can be quite complicated with respect to their upper track and lower edge guide means. U.S. Pat. No. 4,176,496—Rock, et al discloses a multi-panel arrangement in which the outer panel encloses entirely around the support means for the inner panel such that the two panels can pass without interference. U.S. Pat. No. 4,228,560—Baus teaches a complicated sill arrangement characterized by a removable abutment part in the sill. Resilient spacing and/or anti-friction elements in various shapes according to Baus allow panels to rest against one or both sides of the sill channel, and against one another. Any hair or dirt that falls on the sill piece can be rinsed away in a channel defined under this removable abutment. This arrangement is apparently effective, but is quite complicated, expensive and subject to difficulties.

U.S. Pat. No. 4,258,443—Baus employs downwardly-turned channel members on the sill, thereby avoiding any receptacle apt to accumulate dirt. This patent has a range of embodiments and variations in which 1, 2 or 3 downwardly-turned channels can support three panels. Arrangements include a one channel embodiment (FIG. 1) in which each of the door panels has an outrigger spaced from its respective door panel by the required distance to extend under the downwardly opening sill piece channel. Alternatively, two of the panels can have such outriggers and a third panel can be mounted to guide along a flange or channel on the second panel (as in FIG. 2). Overlapping/underlapping guide arrangements are also disclosed, allowing the panels to lap one another to a limited extent. This closure structure benefits from its relatively-simple sill shape, with a downwardly-turned channel guide on the sill. However, the number and variation of these channels is rather complicated, and may present difficulties, especially for a do-it-yourself installer.

According to the present invention, a three panel door enclosure is provided. One of the panels straddles a downwardly-turned channel, while the other two channels are mounted by guide members having outrigger pins extending upwardly into the channel from below. Therefore, a very simple dirt-free sill arrangement is provided, having only a single channel that is upwardly rounded toward the opening (i.e., the channel opens downwardly). Nevertheless, all three panels are positively supported.

A first guide member comprising a simple C-shaped sliding guide is preferably fixed in the middle panel by one of the two legs of the C shape, and slidably guided in the sill channel by the other of the legs of the C. A second guide member, preferably also fixed in the center panel, has a first leg or outrigger guided in the sill channel and also has an opposite outrigger, received in the downward edge of the third, and most-inwardly disposed panel of the three panel closure. Preferably, handlelike extensions protrude transversely on the edges of each panel, preventing adjacent panels from passing entirely by one another, yet allowing the panels to lap. The invention thus provides the easy cleaning and safety benefits of smooth sill pieces and the positive edge alignment capabilities of complicated panel arrangements having a greater number of part, dirt-trapping sill channels and the like.

SUMMARY OF THE INVENTION

It is an object of the invention to provide an inexpensive and durable enclosure for multi-panel sliding doors.

It is another object of the invention to provide a sliding panel bath enclosure having a minimum of dirt-catching areas.

It is another object of the invention to provide a compact bath enclosure mounting with a minimum width in a direction transverse to the direction of sliding.

It is still another object of the invention to provide a simple and effective panel guide means using a minimum number of parts.

These and other objects are accomplished by a bath enclosure having three panels suspended from a header with three parallel tracks, and a sill disposed under the header with a sill channel opening downardly and inwardly toward the bath enclosure. A first of the door panels is guided by its lower edge straddling the sill channel. The second and third of the panels have lower edges provided with guide means including outriggers slidable in the sill channel. A C-shaped guide preferably positions the second panel relative to the sill, the outrigger being one of the legs of the C-shape. A E-shaped guide positions the second and third panels relative to one another and relative to the sill channel. The panels preferably have protruding means along their vertical edges that allow the panels to lap but prevent adjacent panels from passing completely by one another.

BRIEF DESCRIPTION OF THE DRAWINGS

There are shown in the drawings the embodiments that are presently preferred. It should be understood that the invention is not limited to the precise arrangements and instrumentalities shown in the drawings, and further that the invention is capable of embodiment in other subcombinations and groups of features which may be shown in the drawings in other groupings, for purposes of illustration. In the drawings.

DETAILED DESCRIPTION OF THE PREFERRED EMBODIMENTS

Figure 1:
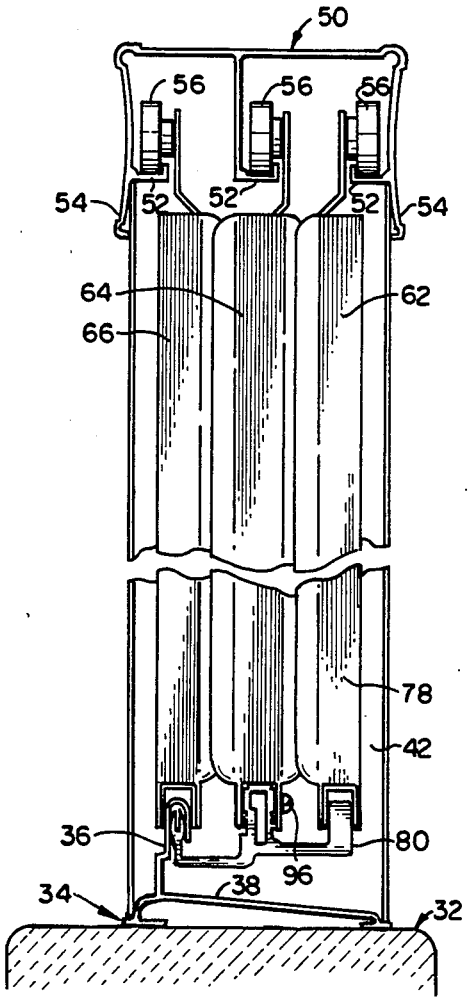
FIG. 1 is an end view of a closure according to the invention, a central portion of indefininte length being cut away, and the E-shaped guide being shown.
Figure 10:
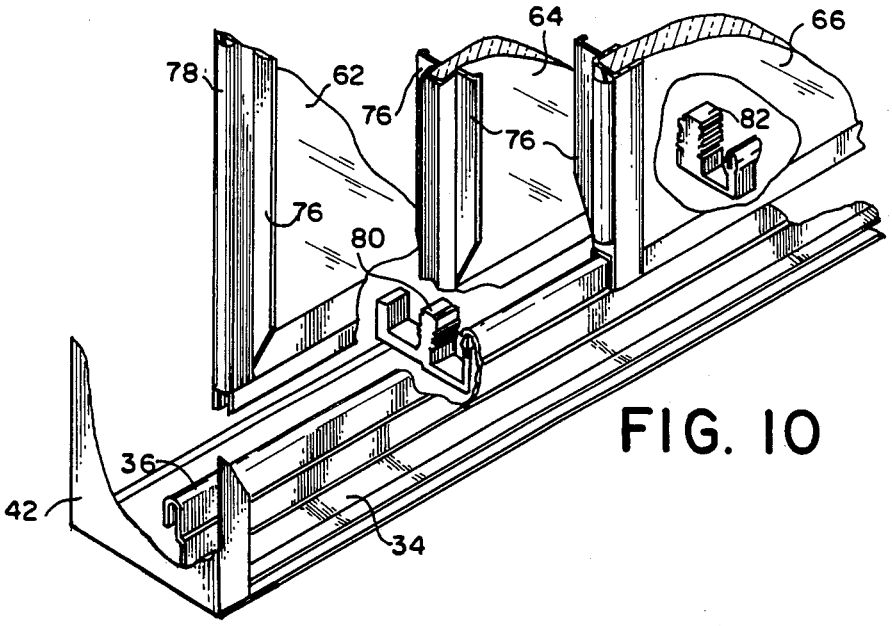
FIG. 10 is a partial cut away perspective view showing the three panels according to the invention and their guide means.

FIG. 1 shows a plurality of slidable door panels 62, 64, 66 that together define a closure between a header rail 50 and a tub 32 or other wall of a basin, sill or the like. Vertical sidewalls in the enclosure are defined by vertical wall channels 42 at opposite sides. Water sprayed or splashed from a shower or the like is to be confined to the inside of the enclosure, namely to the right side as shown in FIG. 1 and to the rear as shown in FIG. 10.

Sill piece 34, side channels 42 and header 50 can be metal, plastic or other material and preferably are aluminum extrusions. Header 50 has a sliding guideway 52 for each of the panels, each of the panels being suspended from a wheel 56. In the preferred embodiment as shown, the middle panel 64 is mounted such that its center of gravity is immediately below its respective track while the inner panel 62 and outer panel 66 are suspended from tracks located slightly outwardly from their centers of gravity, causing the outer panels to tend to swing outwardly, but for confinement of the panels by their guides. Header rail 50 has extending side skirts 54, at least slightly overhanging the panels and concealing the suspension mechanism.

The sill member 34 can be separably channel affixed to a flange but is preferably an integral extrusion and is affixed to tub or basin 32 by means of adhesive sealant. Sill 34 has an upper-facing flat area 38, directed inwardly toward the enclosure and defining an uninterrupted smooth draining surface away from which any hair, dirt or the like can be easily rinsed. Sill 34 has a downwardly-opening channel 36 extending along its length. Each of the door panels has a pair of spaced flanges at their lower edges, defining a downwardly opening channel.

According to the invention, the outermost panel 66 is adapted such that its flanged lower edge straddles over channel 36 of sill piece 34 thereby positively positioning the outermost panel without additional guide elements. The outermost panel still is removable, by lifting the panel such that its suspension wheel 56 clears the edge of its track, the panel being lifted off sill channel 36 and coming free. The middle panel 64 and innermost panel 62 are slidably mounted with respect to one another and with respect to channel 36 of sill 34. Two types of guides are provided, whereby at an area of lapping between panels 64, 66, a short guide mechanism is used and in an area of lapping between panels 62, 64, a longer guide mechanism is used. In either event, all three door panels are positively aligned with respect to the sill channel 36 and one another. No means are provided that extend into the enclosure area, where they might be dangerous or unsightly.

The enclosure of the invention is particularly adapted for shower doors, wherein the door encloses an area over an edge of a basin or tub with wall 32 being a protruding wall of the basin or the like between facing sidewalls. The sill piece is disposed along the edge of the basin, the sill having a sill channel substantially in a U-shape defined by two spaced legs, one leg of the sill channel supporting the sill channel, and a second leg being carried at a space above the edge, and the sill channel defining a ridge protruding upwardly and a slot opening downwardly on the edge and inwardly toward the basin. The header is mountable between the sidewalls and extends parallel to the sill channel, defining parallel tracks for the door panels. Typically, the sidewalls are provided with side channels 42, upon which header 50 rests and is supported. Side channels 42 are preferably screwed into the enclosure side walls.

Figure 2:
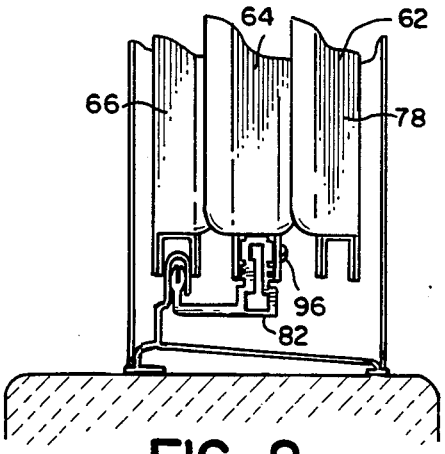
FIG. 2 is a partial view corresponding to FIG. 1, only the lower part of the closure being shown and the C-shaped guide being shown.

The invention can be embodied in connection with a two panel door. Inasmuch as the sill channel has a supporting leg fixed to the sill and a free leg, together defining an upwardly protruding ridge and downwardly opening slot, the structure of the sill channel supports both the panels of the door. An outer panel straddles the sill channel and an inner panel has a sliding outrigger extending from its lower edge, the outrigger having means extending into the straddles sill channel from below. This arrangement is similar to the mounting of panels 64, 66 in FIG. 2 (which in that figure includes also an inner panel 62 for a three panel enclosure). By means of this mounting, guide 82 is rigidly fixed between facing flanges defining a downward opening channel at the bottom of panel 64. Guide 82 may be further affixed by means of a screw 96, passed transversely through at least one of the flanges, and through the thicker base part of guide 82. The outrigger of guide 82 has a horizontal section extending under the channel 36, with an upturned split sliding outrigger part extending into the channel from below. Any lifting or transverse displacement of the bottom edge of panel 64 is prevented by the guide 82. Should only two panels be employed, one or two guide members 82 will be sufficient to maintain the alignment of both the channel-straddling panel 66 and the guide-mounted panel 64. This is accomplished without the requirement for any obstruction, complexities or dirt-catching elements on sill 34.

In the three panel embodiment, the C-shaped guide 82 is mounted at one edge of central panel 64, and an E-shaped guide 80, as shown in FIG. 1, is mounted at the opposite end of panel 64. The E-shaped guide 80 is similar to the C-shapged guide 82 with respect to the portions mounted in panel 64 and extending into channel 36 of sill 34. In addition, however, guide 80 has a second slidable outrigger extending in the opposite direction, and slidably engaged between the facing flanges at the bottom of the innermost panel 62. Guide 80 is carried along with panel 64, but serves to maintain the proper alignment and position of both middle panel 64 and inner panel 62.

Figure 3:
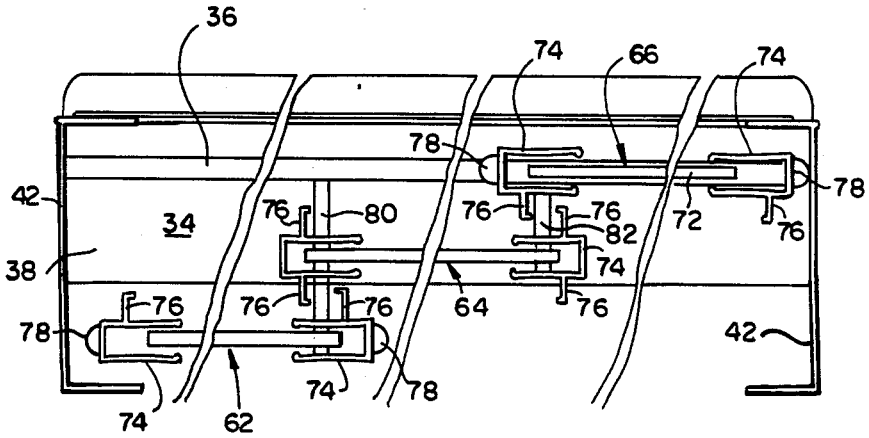
FIG. 3 is a schematic section view in plan, locking vertically downwards in FIG. 1, with indefinite intermediate lengths of the panels shown cut away.

FIG. 3 shows the mounting of guides 80, 82 on the opposite ends of middle panel 64. In this view, taken looking downwardly from under header rail 50, the lapping nature of the door panels is shown. Each of the door panels is made substantially from a glass panel 72 and closed in a framing of channel members 74, and the vertically-oriented channel members are provided with handles or stops 76, which prevent adjacent panels from passing entirely by one another. Bumpers 78, for example rubber strips with spaced protruding fasteners (not shown) to be received in holes in frame elements 74, are placed on the innermost and outermost doors. The stop 76 on the panels keep the middle panel 64 from reaching the ends of the track, as defined by side channels 42. As shown in FIG. 3, center panel 64 has a stop 76 facing in both directions and on both ends. Inner and outer panels 62, 66 respectively have stops 76 only directed toward their adjacent panel, namely the middle panel 64.

Figure 4:
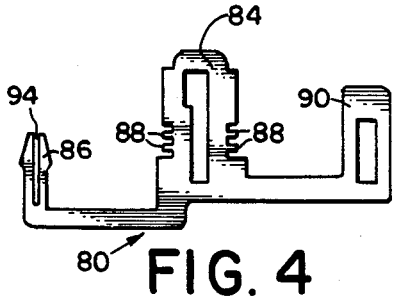
FIG. 4 is a side elevation of the E-shaped guide according to the invention.
Figure 5:
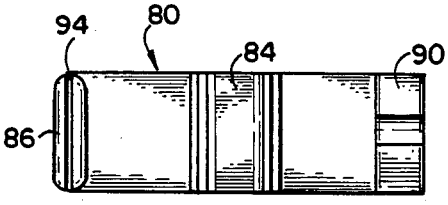
FIG. 5 is a top plan view of the E-shaped guide.
Figure 6:
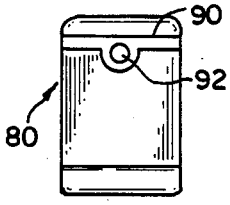
FIG. 6 is an end view of the E-shaped guide from the right in Figs. 4 and 5.
Figure 7:
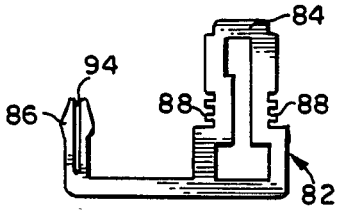
FIG. 7 is a side elevation view of the C-shaped guide of the invention.
Figure 8:
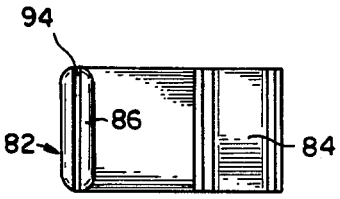
FIG. 8 is a top plan view thereof.
Figure 9:
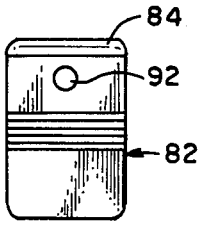
FIG. 9 is an end view from the right in FIGS. 7 and 8.

The particulars of the C-shaped one-runner guide 82 are shown in FIGS. 7–9; the particulars of the E-shaped two-runner guide 80 are shown in FIGS. 4–6. In each case, a central element 84 is insertable and rigidly fixable between the flanges at the lower edge of the door panel, for example the middle door panel. Friction ridges 88 are disposed along the side of the insertable part 84, to keep the inserts in place. Both inserts have in a similar outrigger or slider 86, which may be shaped as a pin, elongated and slotted along the sliding axis, as at slot 94. The web connecting central part 84 and sliding slotted outrigger 86 is relatively thin and resiliently bendable, thereby allowing the user to raise wheel 56 of middle panel 64 out of its header track 52, to remove the middle panel from the closure if necessary, without removing the guide. The guide can also be relatively stiff and closely dimensioned to prevent removal or derailing of a panel. In that case, the guide must be stiff enough to prevent upward displacement sufficient to wheel 56 to clear header track 52. A hole 92 running transverse to the sliding direction is provided for receiving a fastener such as screw 96, threaded through the downwardly-extending flange on one side of the panel and nonremovably securing the guide in place.

Two-slider guide 80, shown in FIGS. 4–6, also has a central part 84 with friction ridges 88, and outrigger 86 with slot 94. Guide 80 has a second outrigger 90, which is adapted to the slidably received in the channel at the bottom edge of the innermost panel 62. In this way, the innermost panel is prevented from swinging transversely of the sliding direction, away from the middle panel, in which guide 80 is ridigly affixed. Moreover, inasmuch as guide 80 is also slidably attached to sill channel 36 and therefore positively positioned relative to outermost panel 66 and to the tub, the entire arrangement of panels is guided and secure.

FIG. 10 shows a perspective view of the bottom edges of the door and the sill track, as viewed from outside of the enclosure. Sill 36 presents a smooth rounded surface unlikely to injure a user and presenting no receptacle for accumulation of dirt and hair. Outermost panel 66, riding along on sill channel 36, presents a neat and secure appearance from outside, panel 66 extending over the sill channel with no gap or exposed edges. While there is a gap between the bottom edge of the innermost panel 62 and the surface of sill 34, this gap exposes only a smooth sill surface and in any event occurs on the inside where space and flat surfaces are helpful because they allow hair and dirt to rinse off the sill plate. First guide 82 is mounted at the edge of central panel 64, lapping outer panel 66. Second guide 80, namely the E-shaped guide, is mounted at the end of panel 64 lapping innermost panel 62. In each case, guides 80, 82 are of a reasonably substantial width, for example 2 or 3 cm. in the sliding direction, making the guides less likely to bind. The guides 80, 82 are preferably molded nylon, but may be any form of resilient slidable material, for example of plastic, rubber or the like.

The preferable guides 80, 82 are arranged such that slotted pin 86 is slightly compressed when inserted in channel 36, thereby providing some friction and eliminating play in the guidance of the panels. It is also possible to use such a compressible structure in place of second outrigger 90 of E-shaped guide 80. However, this tends to cause panels 62, 64 to move together as a unit and detracts from the equal and independent operation of the panels. Other outrigger structures are also possible, for example elongated sliders and rollers.

Figure 11:
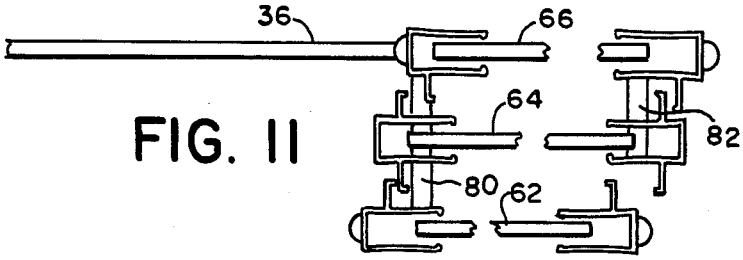
FIG. 11 is a schematic illustration of the lapping of the panels.
Figure 12:
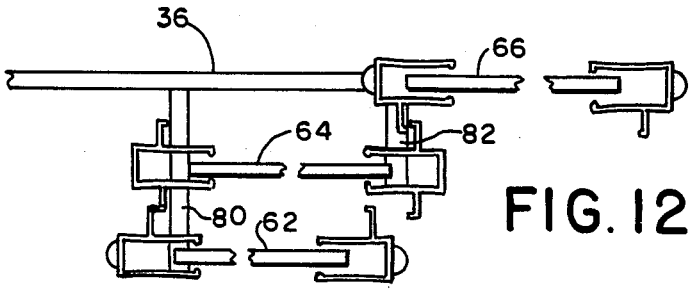
FIG. 12 is a further schematic illustration of the lapping of the panels.

FIGS. 3, 11 and 12 show interaction of the panels and the guides. With reference to FIG. 3, where all the panels are extended to close the shower door or the like, the two guide 80, 82 hold panel 64 with respect to sill channel 36. Although guide 80 extends inwardly toward the shower area past adjacent middle panel 64, the guide only extends in the area that will necessarily be occupied by panel 62 due to the arrangement of handles/stops 76 that prevent the panels from passing completely by their neighboring panel. In opening the door, for example from the inside, the user slides panel 62 to the right as shown progressively by Figs., 3, 12 and 11. In FIG. 12, the arrangement of stop 76 prevents panel 62 from completely passing panel 64. Similarly, from the other side, when the user continues to open the closure by sliding panel 62 to the right, or by sliding panel 66 in the opposite direction, eventually all the handles 76 come into engagement.

Both guides 80, 82 are preferably fixed in the middle panel and slidable relative to the inner panel and/or sill channel. It is possible to arrange the guides 80, 82 such that the center panel slides on the guide rather than the innermost panel. In that case, guide 80 is affixed to the end of panel 62 that just overlaps panel 64. This arrangement also aligns all three panels with respect to track 36. Where the E-shaped second guide 80 is rigidly affixed to the center panel as preferred, the unsupported length of the guide is minimized and any difficulties with the guide dropping downwardly over time are eliminated.

Smooth operation and freedom from squeaking and scraping noises can be ensured by placing wear surfaces such as nylon liners on the inner faces of the bottom edges of the door panels, especially the innermost panel 62 and outermost panel 66. Undue friction with slider 80 and channel 36 are thereby avoided. A nylon inner channel can be placed in either or both of the downwardly-oriented flanges at the bottom edges of the door panels that slide on one another. Inner panel 62 and outer panel 66 are essentially mirror images of one another, and both are appropriately provided with channel liners.

The device is capable of a number of additional variations and embodiments, within the scope of the invention. Reference should be made to the appended claims rather than the foregoing specification as representing the true scope of the invention.

What is claimed is:

1. A shower door for enclosing an area at an edge of a basin and between facing side walls, comprising:

a sill to be disposed along the edge of the basin, the sill having a sill channel defined in cross section by two spaced legs attached together at one edge thereof, the two spaced legs of the sill channel defining a ridge protruding upwardly and a slot opening downwardly toward the edge, one of said legs being attached to the sill and one of said legs projecting freely downwardly and inwardly toward the basin;

a header mounted between the side walls and extending parallel to the sill channel, the header defining a plurality of parallel tracks; and, a plurality of door panels slidably mountable to move along the tracks on the header, said door panels having spaced flanges along a lower edge thereof straddling the upwardly protruding ridge defined by the two spaced legs of the sill channel, a second of the door panels having a first guide member with an outrigger slidable in the downwardly opening slot defined by the two spaced legs of the sill channel, said shower door further characterized by at least a third door panel, at least three of said tracks and a second guide member, said second guide member also having an outrigger slidable in said downwardly opening slot defined by the two spaced legs of the sill channel, said second guide member being fixed to said second door panel and having a second outrigger slidable between the spaced flanges of said third door panel.

2. The shower door of claim 1, wherein the first guide member is substantially C-shaped in cross section, a first leg of said C-shaped guide member being fixed in the second of the door panels and a second leg of the C-shaped guide member being the outrigger slidable in the sill channel.

3. The shower door of claim 1, wherein the three door panels each have downwardly-opening channels defined along lower edges thereof, the channel of the first door panel straddling the sill channel and the channels of the second and third door panels receiving the guide members.

4. The shower door of claim 1, wherein the second guide member is substantially E-shaped, one leg of the E-shaped guide member being the outrigger slidable in the sill channel and two remaining legs of the E-shaped guide member being the second outrigger and a means for affixing the second guide member to said one of the second and third of the door panels, respectively.

5. The shower door of claim 4, wherein the first and second guide members are frictionally engaged in channels defined between downwardly extending flanges along lower edges of the second and third door panels.

6. The shower door of claim 5, wherein the guide members are further fixed to the panels by screws through the flanges.

7. The shower door of claim 1, wherein the outrigger is a pin elongated in a sliding direction and having a slot oriented parallel to the sill channel.

8. The shower door of claim 4, wherein the three door panels are arranged to overlap one another, the first door panel being an outermost panel of the enclosure and the third door panel being an innermost panel, the C-shaped guide member and the E-shaped guide member being fixed at opposite ends of the second door panel in the sliding direction.

9. The shower door of claim 8, further comprising extensions at each opposite edge of each of the door panels, the extensions being oriented transverse to the tracks and the extensions of adjacent door panels preventing passage of the door panels past one another, the guide members being mounted adjacent the extensions of the second door panel.

10. A sliding panel closure, comprising:

header rail defining three parallel tracks, including an outer track, a middle track and an inner tracks;

a sill rail defining a sill channel disposed substantially below the header rail, the sill channel being a downwardly opening channel defining an upward protruding ridge and downward-opening slot, the sill channel having two spaced legs, a first one of the legs being adapted to support the sill rail on an underlying support and a second of the legs projecting inwardly and downwardly at a space from the first leg, the sill channel defining a ridge protruding toward the header rail and a slot opening away from the header rail;

an outer panel, a middle panel and an inner panel suspended from the header rail and slidable on the outer, middle and inner tracks, respectively, a first one of said panels having spaced flanges along a lower edge defining a downwardly open channel opening away from the header rail and extending over the ridge defined by the sill channel;

a first guide member rigidly fixed to said second panel, the first guide member having a first slidable tab extending upwardly into the slot of the sill channel; and, a second guide member rigidly fixed to said second panel, the second guide member having a first slidable tab extending into the slot of the sill channel and a second slidable tab extending into the third panel.

11. The closure of the claim 10, wherein each of the three door panels has a downwardly opening channel along a lower edge thereof, the first and second guide members being received in the channels of the second and third panels.

12. The closure of claim 10, wherein the first guide member is substantially C-shaped and the second guide member is substantially E-shaped, a first leg of the C-shaped guide member being fixed in the second of the door panels and a second leg of the C-shaped guide member being one of the first and second slidable tabs, and an end leg of the E-shaped guide member being the outrigger slidable in the sill channel and two remaining legs of the E-shaped guide member being the second outrigger, and the other of said first and second slidable tabs, respectively.

13. A bath enclosure, comprising:

a sill having a sill member with two spaced legs defining a slot opening downwardly and inwardly toward a bath area, one of the two spaced legs supporting the channel and being attached to the enclosure and a second of the two spaced legs having a free end extending downwardly and inwardly toward the bath area, the sill member defining an upward-facing ridge and a downward-facing slot aligned substantially over and under one another;

a first door panel movable along the sill, having flanges along a lower edge thereof, dimensioned and spaced to straddle over the ridge of the sill member; and, a second door panel movable along the sill, having an outrigger with a free end extending upwardly into the slot in the sill member, whereby the first door panel is guided on the outside of the sill member and the second door panel is guided on the inside of the sill member, said both enclosure further comprising a third panel, said third door third panel having a downwardly-opening flange on a lower edge thereof and being guided on a second outrigger of said second panel, said second outrigger being fixed to said second panel and having a tab extending upwardly into the bottom edge of said third panel.

14. The bath enclosure of claim 13, further comprising a header rail supporting said first door panel and said second door panel by an end thereof remote from the sill.

* * * * *